United States Patent [19]

Herbst

[11] 3,938,696

[45] Feb. 17, 1976

[54] INCLINED INTEGRAL RIVET ON END PANEL FOR TAB CONTROL

[75] Inventor: Edward J. Herbst, Posen, Ill.

[73] Assignee: Continental Can Company, Inc., New York, N.Y.

[22] Filed: Sept. 18, 1974

[21] Appl. No.: 507,040

[52] U.S. Cl. ..... 220/273
[51] Int. Cl.[2] ..... B65D 41/32
[58] Field of Search ..... 220/269–273

[56] References Cited

UNITED STATES PATENTS

| | | | |
|---|---|---|---|
| 3,428,211 | 2/1969 | Scharf et al. | 220/273 |
| 3,446,390 | 5/1969 | Heffner | 220/273 |
| 3,858,754 | 1/1975 | Patarini et al. | 220/269 |

*Primary Examiner*—George T. Hall
*Attorney, Agent, or Firm*—John J. Kowalik; Joseph E. Kerwin; William A. Dittmann

[57] ABSTRACT

An improved easy-open end closure which maintains close contact between a tab and container end panel prior to opening, regardless of doming of the end panel. An integral rivet is formed on the end panel inclined off-center 10°–20° toward the end panel center, the rivet securing the pull tab thereto whereby the tab converges with the end panel toward the periphery thereof.

4 Claims, 8 Drawing Figures

INCLINED INTEGRAL RIVET ON END PANEL FOR TAB CONTROL

SUMMARY OF THE INVENTION

When easy-open containers employing integral off-center rivets are subjected to excessive internal pressure the end closure bulges outwardly and exerts an upward force on the tab. Occassionally the tab is rotated upwardly about the rivet and retains this displacement after the internal pressure has been reduced and the end panel bulging has subsided. Tab displacement of this sort detracts from the appearance of the container. Further, the exposed tab may be jostled during handling, resulting in either misalignment of the tab and concomitant malfunctioning during opening or unintentional opening of the container.

It is therefore, the primary object of this invention to provide an improved easy-open end closure wherein the tab will maintain close contact with the end panel after cyclical pressure changes in the container.

BRIEF DESCRIPTION OF THE DRAWINGS

The various features and advantages of the improved easy-open closure of this invention will be more apparent from the following detailed description when considered in connection with the accompanying drawing wherein.

DESCRIPTION OF THE INVENTION

Figure 1:
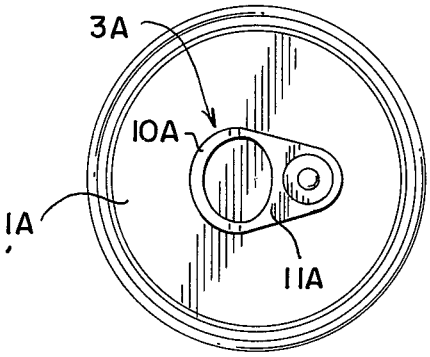
FIG. 1 is a top view of a standard easy-open end closure.
Figure 2:
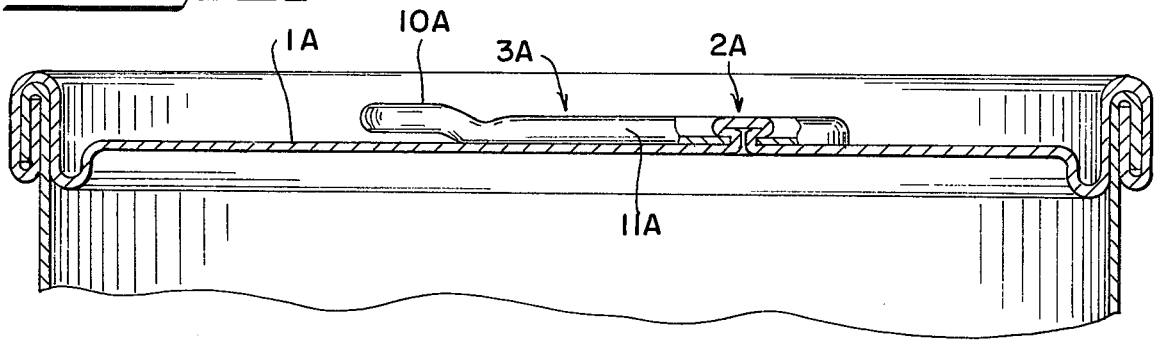
FIG. 2 is a diametrical sectional view of a standard easy-open container closure subjected to normal internal pressure.

As shown in FIGS. 1 and 2, a conventional easy-open end closure has a tab 3A fixedly attached to an end panel 1A by an off-center rivet 2A, said rivet 2A being integrally formed in said end panel 1A and perpendicular thereto, said tab 3A being parallel to, and in close contact with said end panel 1A.

Figure 3:
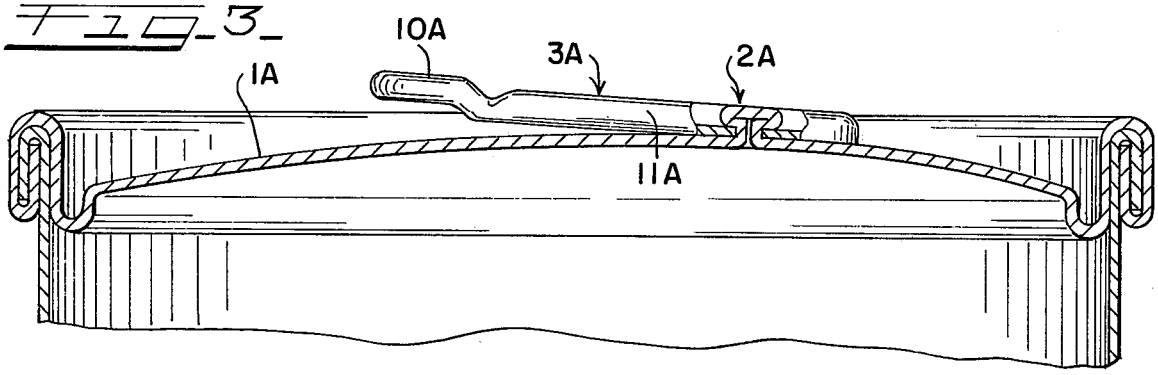
FIG. 3 is a view similar to FIG. 2 wherein the internal pressure has been increased resulting in bulging of the end panel and separation of the tab from the end panel.
Figure 4:
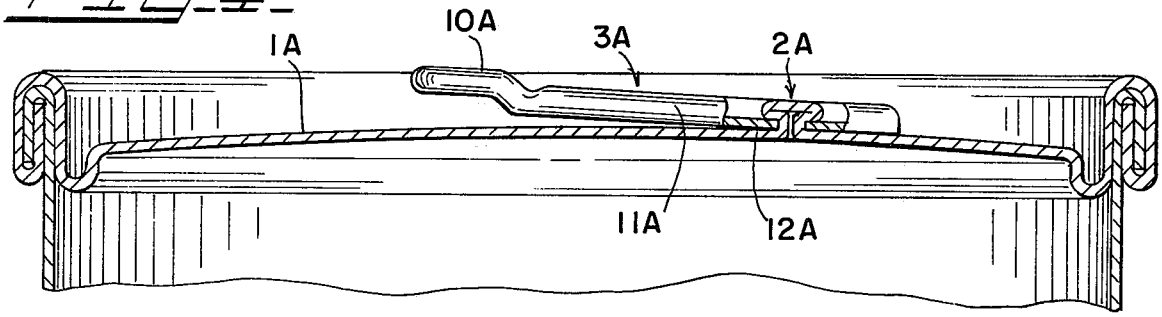
FIG. 4 is a view similar to FIG. 3 wherein the internal pressure has returned to normal leaving the tab with a permanent displacement.

Internal over-pressurization results in doming of the end panel 1A and consequent separation of the tab 3A from the end panel 1A (FIG. 3). Occassionally this bulging results in the tab 3A being rotated upwardly about the rivet 2A and retaining this displacement after the internal pressure has been reduced and the end panel bulging has subsided (FIG. 4).

Figure 5:
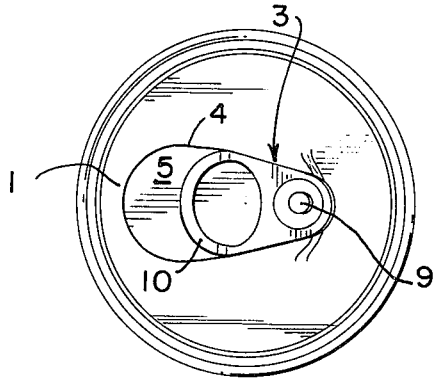
FIG. 5 is a top view of the improved easy-open end closure of the present invention.
Figure 6:
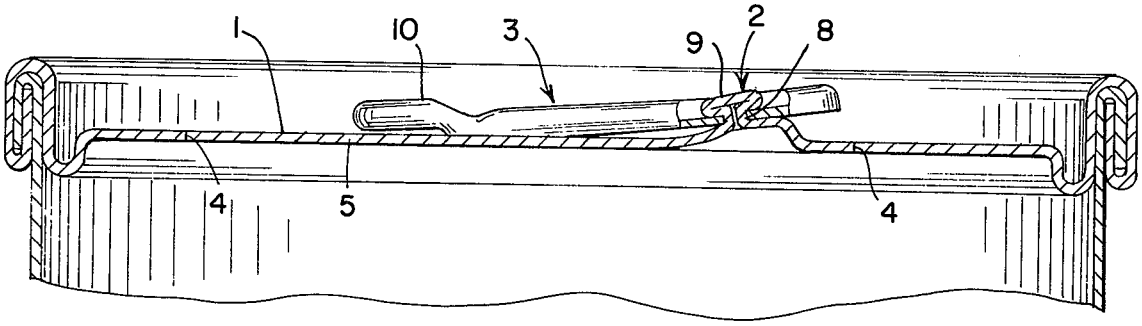
FIG. 6 is a diametrical sectional view of the improved easy-open end closure of the present invention.
Figure 7:
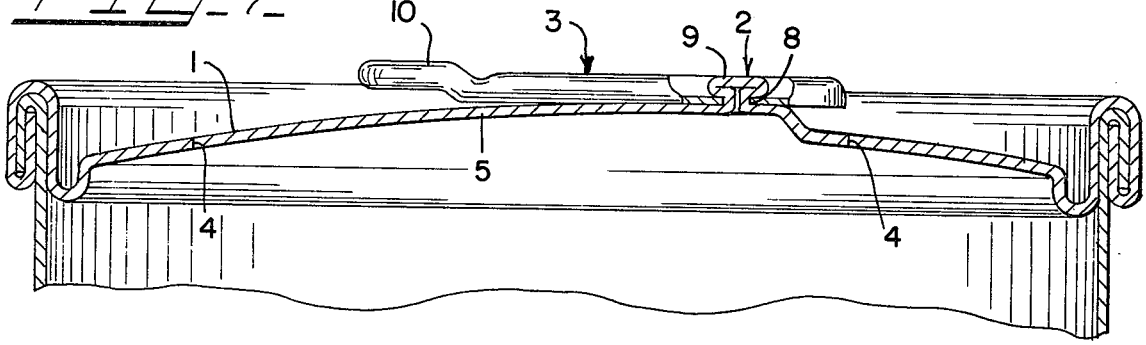
FIG. 7 is a view similar to FIG. 6 wherein the internal pressure has been increased resulting in bulging of the end panel and separation of the tab from the end panel.
Figure 8:
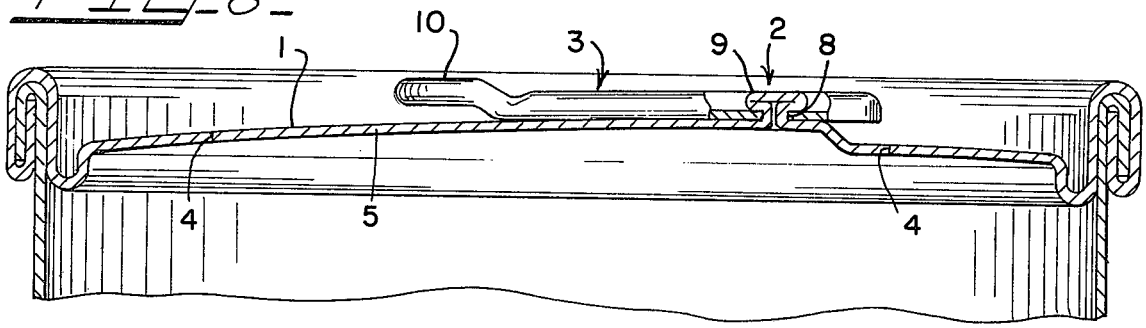
FIG. 8 is a view similar to FIG. 7 wherein the internal pressure has returned to normal and the tab has returned to its original position in close contact with the end panel.

As shown in FIGS. 5 and 6, the closure of this invention comprises a metal end panel 1 with integral off-center rivet 2, said rivet 2 being inclined toward the center of said end panel. A metal tab 3 is fixedly attached by said rivet 2 to said end panel 1 and a score line 4 is formed in said end panel 1 and defines an opening flap 5 therein.

Inclination of the rivet 2 imparts a counter-rotational downward force or bias on the tab 3. This force insures that the tab 3 will maintain and is held, in a position in close contact with the end panel 1 after cyclical pressurization of the container. An inclination of 15° from the vertical is preferred although inclinations of between 10° to 20° have been found to be effective. The tab 3 which is preferably metal, is sprung against the end panel 1 and the resiliency of the tab 3 insures that it will float with the destention and contraction of the end panel 1. The tab 3 has one end comprising an opening receiving the rivet shank 8 therethrough. The rivet 2 has a head 9 formed thereon which is staked against the tab 3. The tab 3 has a finger-grip portion 10 at its other end which is wide and seats across a large expanse of the end panel 1 thus resisting rotation.

It will be noted that regardless of the bulging of the end panel 1, the tab 3 is held pressed down against the end panel 1 whereas in the conventional construction shown in FIGS. 1-4, the finger grip portion 10A of the tab 3A is spaced away from the panel by the intermediate portion 11A of the tab 3A fulcruming at 12A on the spherical or bulged profile of the end panel 1A.

I claim:

1. An improved easy-opening end closure comprising a substantially planar end panel, a substantially planar tab, a score line formed in said end panel and defining a flap therein for fracturing by the tab to open said closure, and biasing means comprising an offcenter rivet integral with said end panel securing said tab thereto and inclined at an acute angle toward said tab and urging said tab against said end panel.

2. An improved easy-opening end closure as defined in claim 1 wherein said rivet is inclined 10–20° from the vertical.

3. An improved easy-opening end closure as defined in claim 2 wherein said rivet is inclined approximately 15° from the vertical.

4. An anti-rotation fastening between a tab and a container end panel, both said tab and said container end panel being substantially planar, said end panel having a projection thereon comprising an integral rivet shank formed in the end panel and disposed at a non-perpendicular angle to the portion of the panel attached thereto, a tab with an opening therethrough having its axis substantially normal to the principal plane of the tab, said rivet extending through said opening in the tab, and a head formed on the rivet shank for clampingly holding the end between the head and end panel and transversely fixing said tab to hold the same resiliently against the end panel.

* * * * *